US006444091B1

(12) United States Patent
Ward et al.

(10) Patent No.: US 6,444,091 B1
(45) Date of Patent: Sep. 3, 2002

(54) STRUCTURALLY RIGID NONIONIC AND ANIONIC POLYMERS AS RETENTION AND DRAINAGE AIDS IN PAPERMAKING

(75) Inventors: William J. Ward, Glen Ellyn; Andrew J. Dunham, DeKalb; Phillip W. Carter, Naperville; Andrei S. Zelenev, Oak Park, all of IL (US)

(73) Assignee: Nalco Chemical Company, Naperville, IL (US)

( * ) Notice: Subject to any disclaimer, the term of this patent is extended or adjusted under 35 U.S.C. 154(b) by 0 days.

(21) Appl. No.: 09/740,548

(22) Filed: Dec. 20, 2000

(51) Int. Cl.[7] ..... D21H 17/46; D21H 21/10

(52) U.S. Cl. ..... 162/164.1; 162/164.1; 162/164.5; 162/164.6; 162/168.1; 162/168.2; 162/168.3; 162/181.6; 162/181.8; 162/183

(58) Field of Search ..... 162/164.1, 164.3, 162/164.6, 165, 168.2, 168.1, 181.6, 181.8, 164.5, 183, 168.3

(56) References Cited

U.S. PATENT DOCUMENTS

| | | | | |
|---|---|---|---|---|
| 4,749,753 A | | 6/1988 | Nishihara et al. | |
| 4,824,916 A | | 4/1989 | Kershner et al. | |
| 5,095,073 A | | 3/1992 | Peiffer et al. | |
| 5,202,410 A | | 4/1993 | Irwin | |
| 5,733,414 A | * | 3/1998 | Stockwell | 162/165 |

FOREIGN PATENT DOCUMENTS

JP 1987-29251 10/1997

OTHER PUBLICATIONS

N. Sarkar et al., "Rigid Rod Water Soluble Polymers", Journal of Applied Polymer Science, 62, 393–408 (1996).

* cited by examiner

*Primary Examiner*—Peter Chin
(74) *Attorney, Agent, or Firm*—Michael B. Martin; Thomas M. Breininger

(57) ABSTRACT

This invention concerns a method of increasing retention and drainage in a papermaking furnish comprising adding to the furnish an effective amount of a structurally rigid nonionic or anionic polymer.

9 Claims, No Drawings

STRUCTURALLY RIGID NONIONIC AND ANIONIC POLYMERS AS RETENTION AND DRAINAGE AIDS IN PAPERMAKING

TECHNICAL FIELD

This invention is directed to a method for increasing retention and drainage in a papermaking furnish using structurally rigid nonionic and anionic polymers. The structurally rigid polymer may be used alone or in combination with one or more conventional coagulants, flocculants and/or microparticles.

BACKGROUND OF THE INVENTION

In the manufacture of paper, a papermaking furnish is formed into a paper sheet. The papermaking furnish is an aqueous slurry of cellulosic fiber having a fiber content of about 4 weight percent (percent dry weight of solids in the furnish) or less, and generally around 1.5% or less, and often below 1.0% ahead of the paper machine, while the finished sheet typically has less than 6 weight percent water. Hence the dewatering and retention aspects of papermaking are extremely important to the efficiency and cost of the manufacture.

Gravity dewatering is the preferred method of drainage because of its relatively low cost. After gravity drainage more expensive methods are used for dewatering, for instance vacuum, pressing, felt blanket blotting and pressing, evaporation and the like. In actual practice a combination of such methods is employed to dewater, or dry, the sheet to the desired water content. Since gravity drainage is both the first dewatering method employed and the least expensive, an improvement in the efficiency of this drainage process will decrease the amount of water required to be removed by other methods and hence improve the overall efficiency of dewatering and reduce the cost thereof.

Another aspect of papermaking that is extremely important to the efficiency and cost is retention of furnish components on and within the fiber mat. The papermaking furnish represents a system containing significant amounts of small particles stabilized by colloidal forces. The papermaking furnish generally contains, in addition to cellulosic fibers, particles ranging in size from about 5 to about 1000 nm consisting of, for example, cellulosic fines, mineral fillers (employed to increase opacity, brightness and other paper characteristics) and other small particles that generally, without the inclusion of one or more retention aids, would in significant portion pass through the spaces (pores) between the mat formed by the cellulosic fibers on the papermachine.

Greater retention of fines, fillers, and other components of the furnish permits, for a given grade of paper, a reduction in the cellulosic fiber content of such paper. As pulps of lower quality are employed to reduce papermaking costs, the retention aspect of papermaking becomes more important because the fines content of such lower quality pulps is generally greater. Greater retention also decreases the amount of such substances lost to the whitewater and hence reduces the amount of material costs, the cost of waste disposal and the adverse environmental effects therefrom. It is generally desirable to reduce the amount of material employed in a papermaking process for a given purpose, without diminishing the result sought. Such add-on reductions may realize both a material cost savings and handling and processing benefits.

Another important characteristic of a given papermaking process is the formation of the paper sheet produced. Formation may be determined by the variance in light transmission within a paper sheet, and a high variance is indicative of poor formation. As retention increases to a high level, for instance a retention level of 80 or 90%, the formation parameter generally declines.

Various chemical additives have been utilized in an attempt to increase the rate at which water drains from the formed sheet, and to increase the amount of fines and filler retained in the sheet. The use of high molecular weight water-soluble polymers is a significant improvement in the manufacture of paper. These high molecular weight polymers act as flocculants, forming large flocs which deposit on the sheet. They also aid in the dewatering of the sheet.

The high molecular weight water-soluble polymer is typically added after a high shear point in the stock flow system leading up to the headbox of the paper machine. This is necessary since flocs are formed primarily by a bridging mechanism and their breakdown is a largely irreversible process. For this reason, most of the retention and drainage performance of a flocculant is lost by feeding it before a high shear point. To their detriment, feeding high molecular weight polymers after the high shear point often leads to formation problems. The feed requirements of the high molecular weight polymers and copolymers which provide improved retention often lead to a compromise between retention and formation.

While successful, high molecular weight flocculent programs may be improved by the addition of so called inorganic "microparticles" such as copolymers of acrylic acid and acrylamide; bentonite and other clays; dispersed silica based materials; colloidal borosilicate; and naphthalene sulfonate/formaldehyde condensate polymers. The microparticle may be used along with a flocculant as part of a single polymer/microparticle retention and drainage program or along with a coagulant and a flocculant as part of a dual polymer/microparticle retention and drainage program.

In a single polymer/microparticle retention and drainage aid program, a flocculant, typically a cationic polymer, is the only polymer material added along with the microparticle. In such a program, a high molecular weight linear cationic polymer is added to the aqueous cellulosic papermaking suspension before shear is applied to the suspension, followed by the addition of a microparticle such as copolymers of acrylic acid and acrylamide; bentonite and other clays; dispersed silica based materials; colloidal silica; or naphthalene sulfonate/formaldehyde condensate polymers after the shear application. Shearing is generally provided by one or more of the cleaning, mixing and pumping stages of the papermaking process, and the shear breaks down the large flocs formed by the high molecular weight polymer into microflocs. Further agglomeration then ensues with the addition of the microparticle.

Although, as described above, the microparticle is typically added to the furnish after the flocculant and after at least one shear zone, the microparticle effect can also be observed if the microparticle is added before the flocculant and the shear zone.

Another method of improving the flocculation of cellulosic fines, mineral fillers and other furnish components on the fiber mat using a microparticle is in combination with a dual polymer program which uses, in addition to the microparticle, a coagulant and flocculant system. In such a dual polymer/microparticle system one or more coagulants are first added, for instance a low molecular weight synthetic cationic polymer and/or cationic starch. The coagulant may also be an inorganic coagulant such as alum or polyaluminum chlorides. This addition can take place at one or several points within the furnish make up system, including but not limited to the thick stock, white water system, or thin stock of a machine. This coagulant generally reduces the negative surface charges present on the particles in the furnish, such as cellulosic fines and mineral fillers, and thereby promotes a degree of agglomeration of such particles. However, in the presence of other detrimental anionic species, the coagulant serves to neutralize the interfering species enabling aggregation with the subsequent addition of a flocculent. Such a flocculant generally is a high molecular weight synthetic polymer which bridges the particles and/or agglomerates, from one surface to another, binding the particles into larger agglomerates. The presence of such large agglomerates in the furnish, as the fiber mat of the paper sheet is being formed, increases retention. The agglomerates are filtered out of the water onto the fiber web, whereas unagglomerated particles would, to a great extent, pass through such a paper web. In such a program the order of addition of the microparticle and flocculant can be reversed successfully.

However, there is continuing need to develop new methods of improving the retention and drainage performance of the papermaking furnish, thereby increasing the efficiency of pulp or paper manufacture.

SUMMARY OF THE INVENTION

Structurally rigid polymers have been used as substitutes for pulp in papermaking (U.S. Pat. No. 4,749,753; Japanese Patent Application 1987-29251), but not as process additives. We have discovered that adding structurally rigid polymers to papermaking furnishes results in a substantial improvement of the retention and/or drainage properties of the furnishes.

Accordingly, in its principal embodiment, this invention is directed to a method of increasing retention and drainage in a papermaking furnish comprising adding to the furnish an effective amount of a structurally rigid nonionic or anionic polymer.

DETAILED DESCRIPTION OF THE INVENTION

"Structurally rigid polymers" means polymers having a structure where the rotational conformation (degrees of freedom) of the polymer is restricted compared with common flexible polymeric materials. Structural rigidity is imparted to the polymers by incorporating rigid components such as alkenyl, alkynyl, cyloalkyl, heterocyclyl, aryl and heteroaryl groups along the main chain of the polymer. The structurally rigid polymers may be composed entirely of rigid components, or the rigid components may be connected by flexible chains such as alkyl or ether groups, so long as introduction of the flexible groups does not substantially effect the overall rigidity of the polymer. Further, the structurally rigid polymers should be water-soluble or water-dispersible and be nonionic or anionic, preferably anionic. The structurally rigid polymers have a molecular weight of from about 2000 to about 2,000,000, preferably from about 50,000 to about 200,000.

"Aryldiamine" means a heteroaryl or aryl group substituted by two amino (—$NH_2$) groups. The amino groups are separated by at least one ring atom, preferably by at least two ring atoms. Representative aryldiamines include, but are not limited to 4,4'-diamino-2,2'-bipenyldisulfonic acid, 4,4'-diamino-3,3'-bipenyldisulfonic acid, 4,4'-diamino-2,2'-bipenyldisulfonic acid, 3,3-diamino-5,5'-biphenyldisulfonic acid, 4,4-diamino-5,5'-dimethyl-2,2'-biphenyldisulfonic acid, 4,4'-diaminostilbene-2,2'-disulfonic acid, 3,3'-diaminostilbene-2,2'-disulfonic acid, 2,5-diaminobenzenesulfonic acid, 2,4-diaminobenzenesulfonic acid, 3,5-diaminobenzenesulfonic acid, 2,5-diaminobenzene-1,4-disulfonic acid, 3,7-diaminonaphthalene-1,5-disulfonic acid, 3,7-diaminonaphthalene-2,6-disulfonic acid, 5,8-diaminonaphthalene-2,3-disulfonic acid, 4,8-diaminonaphthalene-2,6-disulfonic acid, 4,8-diaminonaphthalene-1,5-disulfonic acid, 5-amino-2-[1-(4-amino-2-sulfophenyl)-isopropyl]benzenesulfonic acid, 5-amino-2-(4-amino-2-sulfophenoxy)benzenesulfonic acid, 5-amino-2-[2-(4-amino-2-sulfophenyl)ethynyl] benzenesulfonic acid, and the like. Preferred aryldiamines are 4,4-diamino-2,2'-bipenyldisulfonic acid and 4,4'-diaminostilbene-2,2'-disulfonic acid.

"Cyclic dicarboxylate" means a cycloalkyl, heterocyclyl, heteroaryl or aryl group substituted by at least two activated carboxyl groups where two of activated carboxyl groups are separated by at least one ring atom, preferably by at least two ring atoms. Representative cyclic dicarboxylates include, but are not limited to benzene-1,4-dicarbonyl chloride, benzene, 1,3-dicarbonyl chloride, 4,4'-biphenyldicarbonyl chloride, 2,6-naphthalenedicarbonyl chloride, 2,7-naphthalenedicarbonyl chloride, 1,5-naphthalenedicarbonyl chloride, 1,4-naphthalenedicarbonyl chloride, 1,2,4,5-benzenetetracarboxylic dianhydride, 1,4,5,8-naphthalenetetracarboxylic dianhydride, 2,3,6,7-naphthalenetetracarboxylic dianhydride, 1,2,5,6-naphthalenetetracarboxylic dianhydride, 1,1,3-trioxo-6-[(1,1,3-trioxo-7-sulfobenzo[3,4-c]1,2-oxathiolen-6-yl)sulfonyl] benzo[c]1,2-oxathiolene-7-sulfonic acid, and the like.

A preferred cyclic dicarboxylate is benzene-1,4-dicarbonyl chloride.

"Activated carboxy group" means a carboxylic acid group that has been converted to a group that will readily react with an amino group to form an amide bond. Representative activated carboxy groups include acid halides, haloformates, activated esters and carbonates.

"Anionic substituent" means a substituent that is negatively charged somewhere in a pH range of from about 1 to about 11. Preferred anionic substituents include —$SO_3H$—, —$CO_2H$—, —$OPO_3H_2$. A more preferred anionic substituent is —$SO_3H$.

"Alkyl" means a monovalent group derived from a straight or branched chain saturated hydrocarbon by the removal of a single hydrogen atom. Representative alkyl groups include methyl, ethyl, n- and iso-propyl, and the like.

"Alkoxy" and "alkoxyl" mean an alkyl-O— group wherein alkyl is defined herein. Representative alkoxy groups include methoxyl, ethoxyl, propoxyl, butoxyl, and the like.

"Alkylene" means a divalent group derived from a straight or branched chain saturated hydrocarbon by the removal of two hydrogen atoms. Representative alkylene groups include methylene, ethylene, propylene, and the like.

"Alkenylene" means a divalent group derived from a straight or branched chain hydrocarbon containing at least one carbon-carbon double bond. Representative alkenylene include —CH=CH—, —$CH_2$CH=CH—, —C($CH_3$)=CH—, —$CH_2$CH=CH$CH_2$—, and the like.

"Alkynylene" means a divalent group derived by the removal of two hydrogen atoms from a straight or branched chain acyclic hydrocarbon group containing a carbon-carbon triple bond. Representative alkynylene include —CH≡CH—, —CH≡CH—$CH_2$—, —CH≡CH—CH($CH_3$)—, and the like.

"Aryl" means an aromatic monocyclic or multicyclic ring system of about 6 to about 20 carbon atoms, preferably of about 6 to about 10 carbon atoms. Aryl also includes ring systems where two aryl groups are connected through alkylene, alkenylene or alkynylene groups. The aryl is optionally substituted with one or more alkyl, alkoxy or haloalkyl groups. Representative aryl groups include phenyl, biphenyl, naphthyl, cis- and trans-stilbene, biphenylmethyl, diphenylacetylene, and the like. The aryl is preferably substituted with one or more anionic substituents as defined herein.

"Cycloalkyl" means a non-aromatic mono- or multicyclic ring system of about 5 to about 10 carbon atoms. Preferred ring sizes of rings of the ring system include about 5 to about 6 ring atoms. The cycloalkyl is optionally substituted with one or more substituents selected from alkyl, alkoxy and haloalkyl. Representative monocyclic cycloalkyl include cyclopentyl, cyclohexyl, cycloheptyl, and the like. Representative multicyclic cycloalkyl include 1 -decalin, norbornyl, adamant-(1- or 2-)yl, and the like.

"Heteroaryl" means an aromatic monocyclic or multicyclic ring system of about 5 to about 10, preferably from about 5 to about 6 ring atoms, in which one or more of the atoms in the ring system is/are element(s) other than carbon, for example nitrogen, oxygen or sulfur. Heteroaryl also includes ring systems where two aryl groups are connected through alkylene, alkenylene or alknynylene groups. The heteroaryl is optionally substituted with one one or more substituents selected from alkyl, alkoxy and haloalkyl. Representative heteroaryl groups include pyridyl, 4,4-dipyridinyl, quinolyl, fliryl, benzofuryl, thienyl, thiazolyl, pyrimidyl, indolyl, and the like.

"Heterocyclyl" means a non-aromatic saturated monocyclic or multicyclic ring system of from about 5 to about 10 ring atoms, in which one or more of the atoms in the ring system is/are element(s) other than carbon, for example nitrogen, oxygen or sulfur. Preferred ring sizes of rings of the ring system include about 5 to about 6 ring atoms. The heterocyclyl is optionally substituted by one or more alkyl, alkoxy or haloalkyl groups. Representative heterocyclyl rings include piperidyl, pyrrolidinyl, piperazinyl, morpholinyl, thiomorpholinyl, thiazolidinyl, 1,3-dioxolanyl, 1,4-dioxanyl, tetrahydrofuranyl, tetrahydrothiophenyl, tetrahydrothiopyranyl, and the like.

"Halogen" and "halo" mean fluorine, chlorine, bromine or iodine.

"Haloalkyl" means an alkyl group, as defmed herein, having one, two, or three halogen atoms attached thereto. Representative haloalkyl groups include chloromethyl, bromoethyl, trifluoromethyl, and the like.

The structurally rigid anionic polymers of this invention may be prepared using methods known in the art for preparing polyamides.

In a preferred aspect of this invention, the structurally rigid polymer is an anionic polymer.

In another preferred aspect, the structurally rigid polymer is a condensation polymer of one or more aryldiamines and one or more cyclic dicarboxylates where at least one of the aryldiamines and cyclic dicarboxylates contains an anionic substitutent.

The structurally rigid nonionic and anionic polymers are preferably prepared by reacting the aryldiamine and cyclic dicarboxylate in the presence of base using an interfacial polymerization technique where the solvent is a mixture of water and an aprotic organic solvent having very little or no miscibility with the water. Examples of suitable organic solvents include methylene chloride, chloroform, carbon tetrachloride, hexane or other aliphatic hydrocarbon solvents, or aromatic solvents such as toluene. A preferred solvent is chloroform. Representative bases include carbonates, bicarbonates, or hydroxides of sodium, lithium, or potassium. Organic tertiary amine bases such as triethylamine, trimethylamine, pyridine, and the like are also suitable. The preferred base is sodium carbonate. Reaction temperatures may range from about 0° C. to about 90° C. with a temperature of from about 20° C. to about 30° C. being preferred. Reaction times can very from several minutes to several hours with about two hours being preferred.

In another preferred embodiment, the structurally rigid anionic polymer is a condensation polymer of one or more aryldiamines, one or more cyclic dicarboxylates and one or more cross linking agents, where at least one of the aryldiamines and cyclic dicarboxylates contains an anionic substitutent.

As used herein, "cross-linking agent" means a multifunctional compound that when added to the polymerizing aryldiamine and cyclic dicarboxylate results in "cross-linked" polymers in which a branch or branches from one polymer molecule become attached to other polymer molecules. Preferred cross-linking agents include any material containing more than two activated carbonyl groups such as 1,3,5-hexanetricarbonyl chloride, citric acid-tricarbonyl chloride, 1,3,5-benzenetricarbonyl trichloride, and the like or more than two amine groups such as 1,3,5-hexanetriamine. A preferred cross linking agent is 1,3,5-benzenetricarbonyl trichloride.

In another preferred aspect, the aryldiamine is 4,4'-diamino-2,2'-biphenyldisulfonic acid or 4,4'-diaminostilbene-2,2'-disulfonic acid.

In another preferred aspect, the cyclic dicarboxylate is benzene-1,4-dicarbonyl chloride.

In another preferred aspect, the structurally rigid anionic polymer is poly(4,4'-diamino-2,2'-biphenyldisulfonic acidbenzene-1,4-dicarbonyl chloride); cross-linked poly(4,4'-diamino-2,2'-biphenyldisulfonic acid/be nzene-1,4-dicarbonyl chloride); poly(4,4'-diaminostilbene-2,2'-disulfonic acid/benzene-1,4-dicar bonyl chloride); cross-linked poly(4,4'-diaminostilbene-2,2'-disulfonic acid/benzene-1,4-dicarbonyl chloride); poly(4,4'-diaminostilbene-2,2'-disulfonic acid/1,2,4,5-benzenetetracarboxylic dianhydride/benzene-1,4-dicarbonyl chloride; or a copolymer of poly(4,4'-diamino-2,2'-biphenyldisulfonic acid/benzene-1,4-dicarbonyl chloride) and poly(4,4'-diaminostilbene-2,2'-disulfonic acid/benzene-1,4-dicarbonyl chloride)

The structurally-rigid anionic polymer of this invention may be used in combination with one or more coagulants and/or flocculants as part of a dual polymer treatment program. The retention and drainage properties of the furnish may also be improved by addition of a microparticle as described herein.

The appropriate dosage of structurally-rigid anionic polymer is determined by adding different doses of the structurally-rigid anionic polymer to a model papermaking slurry either alone, or together with one or more flocculants, coagulants and/or microparticles. The performance of the combined chemical additions is monitored with the focused beam reflectance microscope (FBRM) or other appropriate evaluative measurement (Britt jar, dynamic drainage analyzer, etc.). The range of doses is preferably from about 0.1 about to 50, more preferably from about 0.2 to about 5 and still more preferably about 3 pounds of structurally rigid coagulant/ton product.

"Flocculant" means a chemical agent that is added to a papermaking furnish to assist in the agglomeration of small particles and thereby increase the retention and drainage properties of the furnish. The flocculant may be a non-ionic, anionic, cationic or zwitterionic polymer having a molecular weight of at least about 500,000, preferably of at least about 1,000,000 and more preferably of at least about 5,000,000. The flocculant may be used in the solid form, as an aqueous solution, as water-in-oil emulsion, or as dispersion in water.

"Nonionic flocculant" means homopolymers, copolymers or terpolymers and so on of nonionic monomers. Representative nonionic monomers include acrylamide, methacrylamide, N-tertiary butyl acrylamide, N-vinylformamide, N-vinylpyrrolidone, N-vinylpiperidone, N-vinylcaprolactam, N-vinyl-3-methylpyrrolidone, N-vinypyrrolidone, N-vinylpiperidone, N-vinylcaprolactam, N-vinyl-3-methylpyrrolidone, N-vinyl-5-methylpyrrolidone , N-vinyl-5-phenylpyrrolidone, N-vinyl-2-oxazolidone, N-vinylimidazole, vinylacetate, maleimide, N-vinylmorpholinone, polyethylene oxide (PEO), and the like. Preferred nonionic monomers are acrylamide, methacrylamide and N-vinylformamide. Preferred nonionic flocculants are poly(acrylamide), poly(methacrylamide) and poly(N-vinylformamide).

The dosage of nonionic flocculant is preferably from about 0.001 to about 0.5% (as actives) by weight based on total solids in the slurry, more preferably from about 0.003 to about 0.2% and most preferably from about 0.007 to about 0.1%.

"Cationic flocculant" means any water-soluble polymer of (meth)acrylamide or any water-soluble polymer of N-vinylformamide or related monomers which carries or is capable of carrying a cationic charge when dissolved in water. Representative cationic copolymers of (meth) acrylamide include copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA\HCI), diallyldimethylammonium chloride (DADMAC), methacrylamidopropyltrimethylammonium chloride (MAPTAC) and allyl amine (ALA).

"Anionic flocculent" any polymer comprised of anionic and nonionic monomers means which carries or is capable of carrying a cationic charge when dissolved in water. Representative anionic monomers include acrylic acid, methacrylic acid, 2-acrylamido-2-methyl-1-propanesulfonic acid, acrylamidomethylbutanoic acid, maleic acid, fumaric acid, itaconic acid, vinyl sulfonic acid, styrene sulfonic acid, vinyl phosphonic acid, allyl sulfonic acid, allyl phosphonic acid, sulfomethylated acrylamide, phosphonomethylated acrylamide and the water-soluble alkali metal, alkaline earth metal, and ammonium salts thereof. The choice of anionic monomer is based upon several factors including the ability of the monomer to polymerize with the desired comonomer, the use of the produced polymer, and cost. A preferred anionic monomer is acrylic acid. Preferred anionic flocculants are copolymers of acrylamide and acrylic acid.

The dosage of anionic flocculent is from about 0.001 to about 1%, preferably from about 0.01 to about 0.5% and more preferably from about 0.02 to about 0.25% by weight based on total solids in the slurry.

"Zwitterionic flocculent" means a polymer composed from zwitterionic monomers and, possibly, other non-ionic monomer(s). Representative zwitterionic polymers include homopolymers such as the homopolymer of N,N-dimethyl-N-(2-acryloyloxyethyl)-N-(3-sulfopropyl)ammonium betaine, copolymers such as the copolymer of acrylamide and N,N-dimethyl-N-(2-acryloyloxyethyl)-N-(3-sulfopropyl) ammonium betaine, and terpolymers such as the terpolymer of acrylamide, N-vinyl-2-pyrrolidone, and 1-(3-sulfopropyl)-2-vinylpyridinium betaine. The use of zwitterionic flocculants in papermaking is described in U.S. patent application Ser. No. 09/349,054, incorporated herein by reference.

"Microparticle" means charged materials that improve flocculation when used together with natural and synthetic macromolecules. They constitute a class of retention and drainage chemicals defined primarily by their submicron size. A three dimensional structure, an ionic surface, and a submicron size are the general requirements for effective microparticles.

Microparticle programs enhance the performance of current retention programs and optimize wet end chemistry, paper quality and paper machine efficiency. Microparticles are not designed to be used as a sole treatment. Rather, they are used in combination with other wet end additives to improve retention and drainage on the paper machine. Commonly used microparticles include:

i) copolymers of acrylic acid and acrylamide;

ii) bentonite and other clays;

iii) dispersed silica based materials;

iv) colloidal borosilicate; and v) naphthalene sulfonate/formaldehyde condensate polymers.

Representative copolymers of acrylic acid and acrylamide are described in U.S. Pat. No. 5,098,520, incorporated herein by reference.

Bentonites useful as the microparticle for this process include: any of the materials commercially referred to as bentonites or as bentonite-type clays, i.e., anionic swelling clays such as sepialite, attapulgite and montmorillonite. In addition, bentonites described in U.S. Pat. No. 4,305,781 are suitable. A preferred bentonite is a hydrated suspension of powdered bentonite in water.

Representative dispersed silicas have an average particle size of from about 1 to about 100 nanometers (nm), preferably from about 2 to about 25 nm, and more preferably from about 2 to about 15 nm. This dispersed silica, may be in the form of colloidal, silicic acid, silica sols, fumed silica, agglomerated silicic acid, silica gels and precipitated silicas, so long as the particle size or ultimate particle size is within the above ranges. Dispersed silica in water with a typical particle size of about 4 nm is available from Nalco Chemical Company, Naperville, Ill.

Representative borosilicates are described in Patent Cooperation Treaty Patent Application No. PCT/US98/19339, incorporated herein by reference. Colloidal borosilicate is available from Nalco Chemical Company, Naperville, Ill.

Naphthalene sulfonate/formaldehyde condensate polymers useful as microparticles are available from Nalco Chemical Company, Naperville, Ill.

The amount of microparticle added is from about 0.05 to about 5.0, preferably from about 1.5 to about 4.5 and more preferably about 2 to about 4.5 pounds microparticle/ton.

"Pounds microparticle/ton" means pounds of actual microparticle per 2000 pounds of solids present in slurry. The abbreviation for pounds of actual microparticle per 2000 pounds of solids present in slurry is "lbs microparticle/ton".

The microparticle is added to the papermaking furnish either before or after the flocculant is added to the furnish. The choice of whether to add the microparticle before or after the flocculant can be made by a person of ordinary skill in the art based on the requirements and specifications of the papermaking furnish.

Optionally, a coagulant is added to the furnish prior to the addition of the structurally-modified water-soluble polymer. Preferred coagulants are water-soluble cationic polymers such as epichlorohydrin-dimethylamine or polydiallyldimethylammonium chloride, alum, polyaluminum chlorides or cationic starch.

Other suitable coagalants include tie structurally rigid cationic polymers desribed in U.S. patent application Ser. No. 09/740,546, filed concurrently herewith, titled "Structurally Rigid Polymer Coagulants as Retention and Drainage Aids in Papermaking", incorporated herein by reference.

The foregoing may be better understood by reference to the following Examples, which are presented for purposes of illustration and are not intended to limit the scope of this invention.

EXAMPLE 1

Preparation of Poly(4,4'-diamino-2,2'-biphenyldisulfonic Acid/benzene-1,4-dicarbonyl Chloride)("Polymer A")

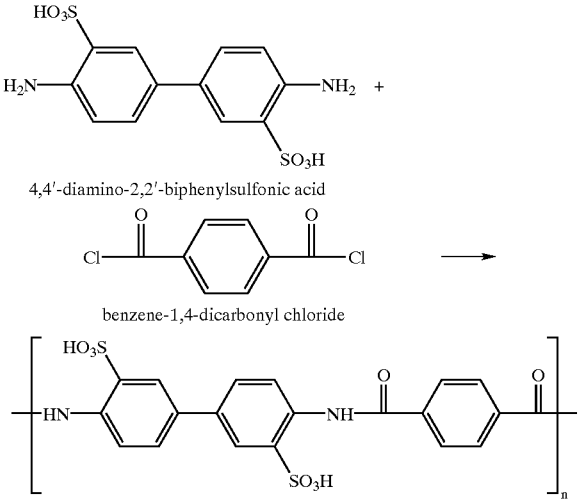

Into a 1-L fluted round-bottom flask equipped with a mechanical stirring shaft, is placed 250 ml of deionized water and 7.95 g of sodium carbonate. The mixture is stirred until the carbonate salt dissolves. Then, 7.641 g of 4,4'-diamino-2,2'-biphenyldisulfonic acid (DABS, 85%) is added, and the mixture is stirred until a homogeneous solution is obtained. A solution containing 2.00 g of PEG 200 dioleate surfactant dissolved in 100 ml of purified chloroform is prepared and set aside. Another solution containing 3.806 g of terephthaloyl chloride dissolved in 100 ml of purified chloroform is also prepared. The reaction flask is stirred at high speed (800–1000 rpm), and the chloroform/surfactant solution is added quickly to the flask. The mixture is stirred for 5 minutes, resulting in an emulsion. Then, the chloroform solution containing the terephthaloyl chloride is added to the flask as quickly as possible. The reaction mixture is stirred at room temperature and at high speed for 2–3 hours. At the end of this period the thickened gel-like solution is poured into a large flask containing 300 ml ethanol/900 ml acetone. The resulting solid is filtered and dried in a vacuum oven to give the desired polymer (9.15 g) as a fluffy light purple solid.

EXAMPLE 2

Preparation of Poly(4,4'-diaminostilbene-2,2'-disulfonic Acid/benzene-1,4-dicarbonyl Chloride) ("Polymer B")

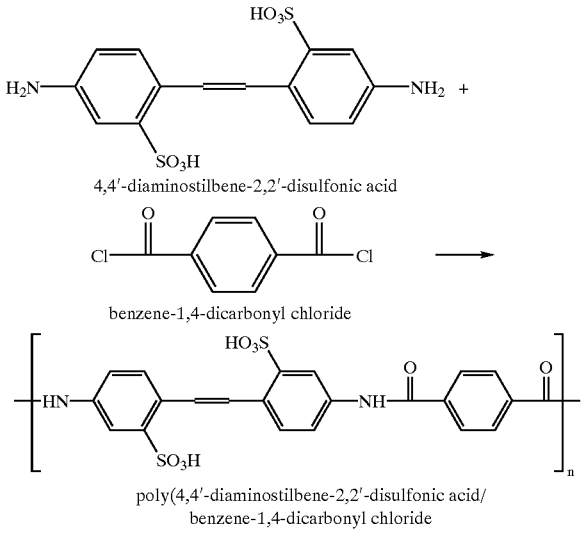

Into a 1-L fluted round-bottom flask equipped with a mechanical stirring shaft, is placed 250 ml of deionized water and 2.65 g of sodium carbonate. The mixture is stirred until the carbonate salt dissolves. Then, 2.35 g of 4,4'-diaminostilbene-2,2"-disulfonic acid (DASDA, 98.5%) is added, and the mixture is stirred until a homogeneous solution is obtained. A solution containing 2.00 g of PEG 200 dioleate surfactant dissolved in 100 ml of purified chloroform is prepared and set aside. Another solution containing 1.27 g of terephthaloyl chloride dissolved in 100 ml of purified chloroform is also prepared. The reaction flask is stirred at high speed (800–1000 rpm), and the chloroform/surfactant solution is added quickly to the flask. The mixture is stirred for 5 minutes, resulting in an emulsion. Then, the chloroform solution containing the terephthaloyl chloride is added to the flask as quickly as possible. The reaction mixture is stirred at room temperature and at high speed for 2–3 hours. At the end of this period, most of the chloroform is removed from the thickened gel-like mixture by rotary evaporation. The reaction mixture is then added to 600 ml of acetone and stirred, and the resulting solid vacuum is filtered and dried in a vacuum oven to provide the desired polymer (3.8 g) as a hard brittle yellow solid.

EXAMPLE 3

Preparation of Crosslinked Poly(4,4'-diamino-2,2'-biphenyldisulfonic Acid/benzene-1,4-dicarbonyl Chloride)("Polymer C")

Into a 1-L fluted round-bottom flask equipped with a mechanical stirring shaft, is placed 250 mL of deionized water and 7.95 g of sodium carbonate. The mixture is stirred until the carbonate salt is dissolved. Then, 7.64 g of 4,4'- diamino-2,2'-biphenyldisulfonic acid (DABS, 85%) is added and stirring is continued until a homogeneous solution is obtained. A solution containing 2.00 g of PEG 400 distearate surfactant dissolved in 100 mL of purified chloroform is prepared and set aside. Another solution containing 3.79 g of terephthaloyl chloride and 0.05 g of 1,5-benzenetricarbonyl trichloride dissolved in 100 mL of purified chloroform is also prepared. The reaction flask is stirred at high speed (800–1000 rpm), and the chloroform/surfactant solution is added quickly to the flask. The mixture is stirred for five minutes, resulting in an emulsion. Then, the chloroform solution containing the terephthaloyl chloride added to the flask as quickly as possible. The reaction mixture is stirred at high speed at room temperature for 2–3 hours. At the end of this period the thickened gel-like solution is poured into large flask containing 300 mL ethanol/900 mL acetone. The resulting solid is filtered and dried in a vacuum oven to provide 9.15 grams of the desired polymer as a fluff, light purple solid.

EXAMPLE 4

Preparation of a 1:1 Copolymer of Poly(4,4'-diamino-2,2'-biphenyldisulfonic Acid/benzene-1,4-dicarbonyl Chloride) and Poly(4,4'-diaminostilbene-2,2'-disulfonic Acid/benzene-1,4-dicarbonyl Chloride)("Polymer D").

Into a 1-L fluted round-bottom flask equipped with a mechanical stirring shaft is placed 250 ml of deionized water and 3.13 g of sodium carbonate. The mixture is stirred until the carbonate salt dissolves. Then, 1.39 g of 4,4'-diaminostilbene-2,2"-disulfonic acid (DASDA, 98.5%) and 1.27 g of 4,4'-diamino-2,2'-biphenyldisulfonic acid (DABS, 85%) are added and the mixture is stirred until a homogeneous solution is obtained. A solution containing 2.00 g of PEG 200 dioleate surfactant dissolved in 100 ml of purified chloroform is prepared and set aside. Another solution containing 1.50 g of terephthaloyl chloride dissolved in 100 ml of purified chloroform is also prepared. The reaction flask is stirred at high speed (800–1000 rpm), and chloroform/surfactant solution is added quickly to the flask. The mixture is stirred for 5 minutes, resulting in an emulsion. Then, the chloroform solution containing the terephthaloyl chloride is added to the flask as quickly as possible. The reaction mixture is stirred at room temperature and at high speed for 2–3 hours. At the end of this period the majority of the chloroform is removed from the thickened gel-like solution by rotary evaporation. The reaction mixture is then added to 600 ml of acetone, stirred and the resulting solid is dispersed in 200 ml of water and re-precipitated into 800 ml of acetone. The solid is then vacuum filtered, and dried in a vacuum oven to give the desired polymer (4.6 g) as a yellow powder.

EXAMPLE 5

Preparation of a 1:3 Copolymer of Poly(4,4'-diamino-2,2'-biphenyldisulfonic Acid/benzene-1,4-dicarbonyl Chloride) and Poly(4,4'-diaminostilbene-2,2'-disulfonic Acid/benzene-1,4-dicarbonyl Chloride)("Polymer E")

Into a 1-L fluted round-bottom flask equipped with a mechanical stirring shaft is placed 250 ml of deionized water and 3.134 g of sodium carbonate. The mixture is stirred until the carbonate salt dissolves. Then, 2.08 g of 4,4'-diaminostilbene-2,2"-disulfonic acid (DASDA, 98.5%) and 0.75 g of 4,4'-diamino-2,2'-biphenyldisulfonic acid (DABS, 85%) are added and the mixture is stirred until a homogeneous solution is obtained. A solution containing 2.00 g of PEG 200 dioleate surfactant dissolved in 100 ml of purified chloroform is prepared and set aside. Another solution containing 1.50 g of terephthaloyl chloride dissolved in 100 ml of purified chloroform is also prepared. The reaction flask is stirred at high speed (800–1000 rpm) and the chloroform/surfactant solution is added quickly to the flask. The mixture is stirred for 5 minutes, resulting in an emulsion. Then, the chloroform solution containing the terephthaloyl chloride is added to the flask as quickly as possible. The reaction mixture is stirred at room temperature and at high speed for 2–3 hours. At the end of this period, the majority of the chloroform solvent is removed by rotary evaporation. The reaction mixture is then added to 600 ml of acetone and stirred and the resulting solid is dispersed in 200 ml of water and re-precipitated into 800 ml of acetone. The solid is then vacuum filtered and dried in a vacuum oven to give the desired polymer (4.8 g) of a yellow powder.

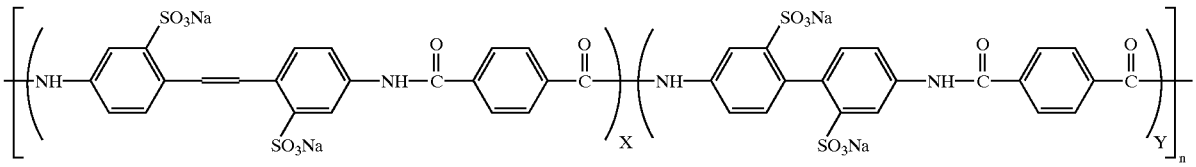

Example 4 X/Y = 1/1
Example 5 X/Y = 1/3

EXAMPLE 6

Preparation of Cross-linked Poly(4,4'-diaminostilbene-2,2"-disulfonic Acid/Benzene-1,4-dicarbonyl Chloride)("Polymer F")

Into a 1-L fluted round-bottom flask equipped with a mechanical stirring shaft, is placed 300 mL of deionized water and 5.33 g of sodium carbonate. The mixture is stirred until the carbonate salt is dissolved. Then, 4.70 g of 4,4'-diaminostilbene-2,2"-disulfonic acid (DASDA, 98.5%) is added and stirring is continued until a homogeneous solution is obtained. A solution containing 2.00 g of PEG 200 dioleate surfactant dissolved in 100 mL of purified chloroform is prepared and set aside. Another solution containing 2.49 g of terephthaloyl chloride and 0.067 g of 1,3,5-benzenetricarbonyl trichloride dissolved in 100 mL of purified chloroform is also prepared. The reaction flask is stirred at high speed (800–1000 rpm), and the chloroform/surfactant solution is added quickly to the flask. The mixture is stirred for 5 minutes, resulting in an emulsion. The chloroform solution containing the terephaloyl chloride is then added to the flask as quickly as possible. The reaction mixture is stirred at high speed at room temperature for 2–3 hours. At the end of this period, the majority of the chloroform is removed from the thickened gel-like solution by rotary evaporation. The reaction mixture is then added to 600 ml of acetone and stirred. The resulting solid is vacuum filtered, and dried in a vacuum oven to provide 3.8 g of the desired polymer as a hard brittle yellow solid.

EXAMPLE 7

Preparation of Poly(4,4'-diaminostilbene-2,2'-disulfonic Acid/1,2,4,5-benzenetetracarboxylic Dianhydride/benzene-1,4-dicarbonyl Chloride) ("Polymer G")

Into a 1-L fluted round-bottom flask equipped with a mechanical stirring shaft, is placed 250 ml ml of deionized water and 3.03 g of sodium carbonate. The mixture is stirred until the carbonate salt dissolves. Then, 2.50 g of 4,4'-diaminostilbene-2,2"-disulfonic acid (DASDA) 98.5% is added and the mixture is stirred until a homogeneous solution is obtained. A solution containing 2.00 g of PEG 200 dioleate surfactant dissolved in 100 ml of purified chloroform is prepared and set aside. Another solution containing 1.09 g of terephthaloyl chloride, and 0.40 g of 1,2,4,5-benzenetetracarboxylic dianhydride dissolved in 100 ml of purified chloroform is also prepared. The reaction flask is stirred at high speed (800–1000 rpm), and the chloroform/surfactant solution is added quickly to the flask. The mixture is stirred for 5 minutes, resulting in an emulsion. The chloroform solution containing the terephthaloyl chloride and 1,2,4,5-benzenetetracarboxylic dianhydride is then added to the flask as quickly as possible. The reaction mixture is stirred at room temperature and at high speed for 2–3 hours. At the end of this period the majority of the chloroform solvent is removed from the thickened solution by rotary evaporation. The reaction mixture is then added to 600 ml of acetone and stirred and the resulting solid vacuum filtered. The solid was re-dispersed in 150 ml of water, then precipitated in a solution of methanol/acetone (200 ml/500 ml). The solid is collected by filtration and dried in a vacuum oven to provide the desired polymer (3.8 g) as a hard brittle mustard-yellow solid.

EXAMPLE 8

The effect of the structurally rigid anionic polymer of this invention in combination with a coagulant and a flocculant on drainage times for a papermaking furnish is measured using a Dynamic Drainage Analyzer ("DDA", available from AB Akribi Kemikonsulter, Stockholm, Sweden), a computer-controlled instrument designed to simulate drainage of papermaking slurries on the wet-end of a paper machine. The DDA consists of a stirred, baffled jar having a screen at the base (0.15, 0.25, 0.315 or 0.5 mm screen openings). A papermaking slurry is added to the jar, and the desired chemical treatment program is then added under shear (propeller speed=1000 RPM) to the furnish. After this mixing period, a pneumatic valve is opened, and the furnish begins to drain under the influence of an applied vacuum (0.25 bar). The DDA is described in detail by S. Forsberg and M. Bengtsson, TAPPI Proc. 1990 Papermakers Conference, Atlanta, Apr. 23–25, 1990. A representative treatment scheme is listed below:

0 s: start mixing 10 s: add a coagulant 20 s: add a flocculent 30 s: add a microparticle 40 s: open valve, begin drainage In the drainage experiments the vacuum in the system is continuously monitored. When the valve is initially opened, the vacuum experiences short initial drop due to the removal of residual air from the instrument by flowing fluid. After a few seconds it increases again, and while furnish drains it may remain steady or increase. As the furnish passes through the screen, the retained solid material forms a pad. Once all of the liquid has been removed, the air is sucked through the formed pad and the vacuum starts to decrease. This point at which the vacuum break occurs constitutes the completion of furnish drainage. The period of time between the point at which the valve opens and the vacuum break is a measure of drainage time.

The DDA drainage times obtained for an unfilled hi-brite TMP furnish (mixture of TMP pulp and acetate buffer) are shown in Table 1. In Table 1, the coagulant is poly (epichlorohydrin/dimethylamine), Nalco Chemical Company, Naperville, Ill.). Polymer A is poly(4,4'-diamino-2,2'-biphenyldisulfonic acid/benzene-1,4-dicarbonyl chloride), prepared as described in Example 1.

TABLE 1

DDA Drainage Times for Hi-Brite TMP Furnish at pH = 5

| Coagulant Dose (lb/t) | Flocculant Dose (lb/t) | Microparticle Dose (lb/t) | Microparticle | Drainage Time (seconds) |
|---|---|---|---|---|
| 4 | 2 | — | — | 34.6 |
| 4 | 2 | 1.0 | bentonite | 30.4 |
| 4 | 2 | 2.0 | bentonite | 31.1 |
| 4 | 2 | 3.0 | bentonite | 30.1 |
| 4 | 2 | 1.0 | borosililcate | 31.2 |
| 4 | 2 | 2.0 | borosililcate | 27.2 |
| 4 | 2 | 3.0 | borosililcate | 26.7 |
| 4 | 2 | 0.5 | Polymer A | 28.4 |
| 4 | 2 | 1.0 | Polymer A | 23.8 |
| 4 | 2 | 2.0 | Polymer A | 22.3 |
| 4 | 2 | 3.0 | Polymer A | 23.2 |

As shown in Table 1, the structurally rigid anionic polymer treatment shows a significant improvement in drainage time compared to borosilicate and bentonite microparticles. At a dosage of only 0.5 lb/t the structurally rigid anionic polymer achieves comparable or better drainage proformancee to that achieved using bentonite and borosilicate microparticles at 2.0 lb/t, representing a replscment ratio of 0.25. In addition, the structurally rigid anionic polymer yields a furnish drainage time of 22.3 seconds which is over 4 seconds faster than the next best microparticle performance.

EXAMPLE 9

The retention and drainage performance of a representative structurally rigid anionic polymer in combination with a cationic coagulant is measured using the Dynamic Drainage Analyzer. The sequence of chemical addition is as follows:

0s: start mixing, add Solvitose N starch;

10s: add coagulant;

20s: add flocculant;

30s: add microparticle or rigid polymer;

40s: drain.

The pulp furnish is prepared by mixing the thick stock components and clay filler obtained from a midwest paper mill. The thick stock fiber components are mixed to yield the ratios described in Table 2 and diluted with the white water obtained from the mill that is purified from insoluble material by filtration through the Whatman 40 filter paper. Into this mixture the appropriate amount of filler slurry is added. Final consistency of the furnish is 1%.

TABLE 2

Composition of test furnish prepared from thick stock components, filler, and white water from a midwest paper mill

| Component | % of total furnish (by weight) |
|---|---|
| Fiber | 82 |
| Hi-Bright TMP Pulp | 5.74 |
| Lo-Bright TMP Pulp | 34.44 |
| Kraft | 17.22 |
| Coated Broke | 8.20 |
| Raw Broke | 16.4 |
| Filler | |
| Clay filler | 18 |

The results of drainage studies are summarized in Table 3. In Table 3, Coagulants 1, 2 and 3, are, respectively, poly (Epi/DMA), $NH_3$ crosslinked; poly(Epi/DMA) uncrosslinked ("linear"); and poly DADMAC. The flocculent is 10 mole % AcAm/DMAEA MCQ and the microparticle is colloidal borosilicate. The coagulants, flocculent and colloidal borosilicate microparticle are available from Nalco Chemical Company, Naperville, Ill. Bentonite clay is available from Southern Clay Products, Inc., Gonzales, Tex., and Solvitose N Starch is available from Avebe America Inc., Princeton, N.J.

The data summarized in Table 3 shows that under comparable conditions, quicker drainage ieved using representative structurally rigid polymers of this invention compared to bentonite and borosilicate. cl Example 10

The retention effectiveness of the structurally rigid anionic polymers in the absence of flocculant is evaluated with the Britt Jar. The Britt Jar permits direct measurement of first-pass retention of solids under turbulent conditions. The Britt Jar is described in TAPPI J., 56(10), 46 (1973) and TAPPI J., 59(2), 67 (1976).

The instrument consists of a cylindrical jar that is 15 cm tall and 10 cm wide equipped with a stirrer. At the bottom of ajar there is a screen with 75 micron holes. A 500 ml batch of furnish is placed inside the Jar, sheared at the desired shear rate (typically 1000 rpm), and drained through the screen by opening the drain valve below the screen. The turbidity of the filtrate, indicative of the amount of solids present, is then measured.

The Britt Jar treatment sequence used is as follows

0s: start; turn on the stirrer (1000 rpm)

10s: add Solvitose N starch, 10 lb/ton

20s: add coagulant

30s: add rigid polymer 40s open the draining valve and start draining

70s: stop draining

The turbidity of filtrates is measured with HACH 2100 AN Turbidimeter. The results of retention performance

TABLE 3

DDA Drainage Times for Representative Structurally Rigid Polymers in combination with Cationic Coagulants

| Coagulant | Coagulant Dose (lb/ton) | Starch Dose (lb/ton) | Flocculant Dose (lb/ton) | Microparticle or rigid polymer | Microparticle polymer Dose (lb/ton) | Drainage Time (s) |
|---|---|---|---|---|---|---|
| None | 0 | 10 | 0 | none | 0 | 36.6 |
| 1 | 5 | 10 | 0 | Polymer A | 3 | 34.5 |
| 1 | 10 | 10 | 0 | Polymer A | 3 | 24.7 |
| 1 | 17 | 10 | 0 | Polymer A | 3 | 17.1 |
| 1 | 17 | 10 | 0 | Polymer A | 1 | 33.7 |
| 1 | 20 | 0 | 2 | none | 0 | 28.5 |
| 1 | 20 | 0 | 2 | borosilicate | 1 | 26.5 |
| 1 | 20 | 0 | 2 | borosilicate | 3 | 22.0 |
| 1 | 20 | 0 | 2 | Polymer A | 1 | 23.9 |
| 1 | 20 | 0 | 2 | Polymer A | 3 | 16.6 |
| 1 | 20 | 0 | 2 | Polymer B | 1 | 30.0 |
| 1 | 20 | 0 | 2 | Polymer B | 3 | 30.8 |
| 1 | 20 | 0 | 2 | Polymer D | 1 | 24.3 |
| 1 | 20 | 0 | 2 | Polymer D | 3 | 16.7 |
| 1 | 20 | 0 | 2 | bentonite | 1 | 27.9 |
| 1 | 20 | 0 | 2 | bentonite | 3 | 27.3 |
| 2 | 5 | 10 | 0 | Polymer A | 3 | 30.7 |
| 2 | 10 | 10 | 0 | Polymer A | 3 | 22.6 |
| 2 | 13 | 10 | 0 | Polymer A | 3 | 21.2 |
| 2 | 13 | 10 | 0 | Polymer A | 1 | 35.0 |
| 3 | 5 | 10 | 0 | Polymer A | 3 | 35.4 |
| 3 | 10 | 10 | 0 | Polymer A | 3 | 24.4 |
| 3 | 22 | 10 | 0 | Polymer A | 3 | 14.9 |
| 3 | 22 | 10 | 0 | Polymer A | 1 | 35.0 |

evaluation with the Britt Jar are summarized in Table 4. In Table 4, the furnish, coagulants and starch are as in Example 9.

TABLE 4

Retention Performance Evaluation Measured with the Britt Jar

| Coagulant | coagulant dose (lb/ton) | starch dose (lb/ton) | Polymer A dose (lb/ton) | Britt Jar Filtrate turbidity (NTU) |
|---|---|---|---|---|
| None | 0 | 0 | 0 | 5802 |
| None | 0 | 10 | 0 | 4885 |
| None | 0 | 10 | 3 | 5034 |
| 1 | | | | |
| 1 | 10 | 10 | 3 | 4167 |
| 1 | 17 | 10 | 3 | 3311 |
| 1 | 17 | 10 | 1 | 4214 |
| 2 | 10 | 10 | 3 | 4167 |
| 2 | 13 | 10 | 3 | 4434 |
| 2 | 13 | 10 | 1 | 4588 |
| 2 | 17 | 10 | 3 | 4211 |
| 3 | 10 | 10 | 3 | 3576 |
| 3 | 20 | 10 | 3 | 3534 |

The data summarized in Table 4 illustrates that representative structurally rigid polymer A, when combined with either of the listed coagulants, was effective in improving first pass retention. Lower turbidity numbers indicate that more material was retained in the jar than in the case of untreated furnish.

EXAMPLE 11

The retention performance of representative structurally rigid polymers is also evaluated by FBRM. FBRM is an analytical technique for the measurement of flocculation by measuring changes in particle mean chord lengths while flocculation is effected in a model system. This measurement is performed using a commmercially available scanning laser microscope (M100F, Lasentec Corporation, Redmond, Wash., USA). In this technique, a 780 nm diode laser is coupled into the sample of interest via a fiber optic bundle and focused to an elliptical beam waist of about 0.8 $\mu$×2 $\mu$. The focused beam is then scanned through the solution in a circular motion (rotating lens) at a velocity of 2 m/s.

When the beam crosses a particle or particle floc, some of the light is reflected back into the probe, and transmitted via fiber optics to an avalanche photodiode detector. The duration of time that this back-scattered light is "seen" by the detector is proportional to the size of the particle scanned by the beam. Since the scanning velocity of the laser is known (2 m/s), the time taken for the laser to scan across a particle can be converted into a particle chord length. The scanning velocity of the laser is much faster than the particle velocity for all reasonable mixing velocities of the sample (<1800 rpm), thus the measurements are not influenced by sample flow velocities. The chord length determination depends solely on the pulse duration of the back-scattered light, therefore, this technique is relatively insensitive to variations in floc reflectivity or density which is problematic with other particle sizing techniques.

The back-scattered light signal is filtered, and the number of individual pulses exceeding a minimum threshold signal level are counted and binned according to their duration. The magnitude of this signal threshold increases as the overall reflected signal strength increases. Essentially only the single particle events above the background reflectance intensity are used to characterize the chord lengths. Typically 1500–3000 total pulses per second are observed. These binned back-scattered light pulses are used to form a histogram, where the number of observed particles per unit time are plotted as a function of chord length. Typical histograms contained 38 bins with chord length sizes ranging from 0.8 to 1000 microns. The histogram of the chord length distribution can be used to calculate a variety of parameters including mean, median, mode, and skewness.

A 200-mm stirrer shaft within the reaction vessel carries a four-blade propeller. Each blade is 7 mm wide and 1 mm thick with a tip-to-tip distance of 50 mm between opposite blades (diameter of arc swept by propeller). The blades have a rectangular shape with a pitch of 45°. The bottom of the blades are set ~1 mm above the bottom of the mixing vessel and the top of the blades are set ~10 mm below the sapphire probe window. The motor shaft rotation is clockwise so that the push of the propeller blades is upward toward the sapphire windows. The sapphire window is at a depth of 60 mm below the solution/air interface of the containment beaker. The cylindrical probe (25 mm diameter) is an effective baffle enhancing vertical mixing of the solutions. The probe and stirrer are wiped clean and rinsed with deionized water between experiments. No effects related to window fouling are observed over the time period of the experiments.

The data obtained using representative structurally-rigid polymers are compared to a representative coagulant in Table 5. A higher value for mean chord length indicates that a higher amount of flocculation has occurred. In Table 5, the coagulant is poly(epichlorohydrin/dimethylamine) and the flocculant is 10 mole % AcAm/DMEA MCQ, all available from Nalco Chemical Company, Naperville, Ill. Staley IBC starch (A. E. Staley Manufacturing Co., Decatur, Ill.) from the mill is used and the colloidal borosilicate is available from Nalco Chemical Company, Naperville, Ill. The furnish is prepared as described in Example 6, above. The addition sequence is as follows:

0s: start measurement; add starch (15 lb/ton) and coagulant (10 lb/ton);

15s: add flocculant at (1 lb/ton);

60s: add colloidal borosilicate or structurally rigid anionic polymer (0.5 lb/ton).

TABLE 5

Retention performance of Structurally Rigid Anionic Polymers Evaluated by the FBRM

| Microparticle at 0.5 lb/ton | Mean Chord Length before microparticle addition ($\mu$m) | Mean Chord Length after microparticle addition ($\mu$m) | Change in the mean Chord Length due to added microparticle, ΔMCL ($\mu$m) |
|---|---|---|---|
| Colloidal borosilicate | 12.23 | 14.34 | 2.11 |
| Polymer A | 12.46 | 18.57 | 6.11 |
| Polymer B | 12.98 | 13.68 | 0.70 |
| Polymer D | 12.97 | 18.89 | 5.92 |
| Polymer E | 12.06 | 18.13 | 6.07 |
| Polymer G | 12.86 | 17.52 | 4.66 |

The data in Table 5 illustrate that reflocculation by structurally rigid polymers is superior to that observed with borosilicate.

EXAMPLE 12

The retention performance of structurally rigid anionic polymers in a synthetic alkaline furnish is evaluated by FBRM. The furnish is prepared as follows.

Synthetic Alkaline Furnish contains 70% fiber (60/40% blend of HWK (hardwood kraft pulp) and SWK (softwood kraft pulp)) and 30% GCC filler from Omya AG, Oftringen, Switzerland). Proper amounts of HWK and SWK thick stock components are mixed and diluted with Chicago Synthetic Tap Water (CSTW#13), and a suspension of GCC filler is added to the mixture. The final pulp consistency is 0.5%.

The CSTW#13 is prepared by adding 100 ml of each of the $CaCl_2.2H_2O$ (55.08 g/L), $MgSO_4.7H_2O$ (46.16 g/L), and $NaHCO_3$(46.20 g/L) solutions to 3 to 5 L of deionized water, an diluting the resulting solution to the final volume of 20 L.

The HWK and SWK thick stocks are prepared from drylap, which is beaten to 340–380 CSF.

The testing sequence used is as follows. The cationic flocculant, colloidal borosilicate and starch are as described in Example 9, above.

0s: start measurement

30s: add Solvitose N starch (10 lb/ton);

45s: add cationic flocculent (6 lb/ton);

90s: add colloidal borosilicate or structurally rigid anionic polymers (0.5 lb/ton).

The results are summarized in Table 6.

TABLE 6

Retention Performance of Structurally Rigid Anionic Polymers in Synthetic Alkaline Furnish by FBRM using Lasentec M500 Instrument

| Microparticle at 0.5 lb/ton | Mean Chord Length before microparticle addition (μm) | Mean Chord Length after microparticle addition (μm) | Change in the mean Chord Length due to added microparticle, ΔMCL (μm) |
|---|---|---|---|
| Colloidal borosilicate | 20.22 | 27.19 | 6.97 |
| Polymer A | 19.76 | 29.34 | 9.58 |
| Polymer B | 19.79 | 29.79 | 10.00 |
| Polymer D | 19.30 | 28.66 | 9.36 |
| Polymer E | 20.29 | 30.87 | 10.58 |
| Polymer G | 20.36 | 28.28 | 7.92 |

The data summarized in Table 6 show that representative structurally rigid polymers are more effective in reflocculating standard alkaline furnish than colloidal borosilicate.

EXAMPLE 13

The retention performance of structurally rigid anionic polymers in a synthetic acid furnish is evaluated by FBRM. The furnish is prepared as follows.

Synthetic Acid Furnish contains 92.5% fiber (same 60/40 HWK/SWK blend as is used to prepare synthetic alkaline furnish) and 7.5% filler (67% kaoline clay (Thiele Kaolin Colo., Sandersville, Ga.) and 33% titanium dioxide). Proper amounts of HWK and SWK thick stock are mixed and diluted with CSTW#13. To this mixture a suspension of filler is added. The final furnish consistency is 0.5%. The pH in the prepared furnish is adjusted to 5.10 with 50% sulfuric acid. The "alum test" is then performed in the following way: 5 ml of 1% solution of papermaker's alum as product (50% actives) is added to 500 ml of furnish, and the pH is measured. If the measured pH differs from the target value of 4.8, more sulfuric acid is added to thin stock, and alum test is repeated again.

Retention performance of structurally rigid anionic polymers is evaluated by FBRM with the Lasentec M500 instrument as described above. In Table 7, the starch, cationic flocculent and colloidal borosilicate are as described in Example 9, above. The following test sequence is used:

0s: start measurement, add Alum (20 lb/ton);

30s: add Solvitose N Starch (10 lb/ton);

45s: add cationic flocculant (6 lb/ton);

90s: add colloidal borosilicate or structurally rigid anionic polymers (0.5 lb/ton).

The results are shown in Table 7.

TABLE 7

Retention Performance of Structurally Rigid Anionic Polymers in Synthetic Acid Furnish by FBRM using Lasentec M500 Instrument

| Microparticle at 0.5 lb/ton | Mean Chord Length before microparticle addition (μm) | Mean Chord Length after microparticle addition (μm) | Change in the mean Chord Length due to added microparticle, ΔMCL (μm) |
|---|---|---|---|
| Colloidal borosilicate | 21.93 | 24.40 | 2.47 |
| Polymer A | 22.67 | 31.85 | 9.18 |
| Polymer B | 23.43 | 28.58 | 5.15 |
| Polymer D | 21.88 | 30.34 | 8.46 |
| Polymer E | 21.66 | 30.94 | 9.32 |
| Polymer G | 21.46 | 26.07 | 4.61 |

The data summarized in Table 7 show that representative structurally rigid polymers are more effective in reflocculating standard alkaline furnish than colloidal borosilicate.

The present invention is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

Changes can be made in the composition, operation and arrangement of the method of the present invention described herein without departing from the concept and scope of the invention as defined in the following claims:

What is claimed is:

1. A method of increasing retention and drainage in a papermaking furnish comprising adding to the furnish an effective amount of a structurally rigid anionic condensation polymer of one or more aryldiamines and one or more cyclic dicarboxylates where at least one of the aryldiamines and cyclic dicarboxylates contains an anionic substitutent.

2. The method of claim 1 wherein the structurally rigid anionic polymer is a condensation polymer of one or more aryldiamines, one or more cyclic dicarboxylates and one or more cross linking agents, where at least one of the aryldiamines and cyclic dicarboxylates contains an anionic substitutent.

3. The method of claim 1 wherein the aryldiamine is 4,4'-diamino-2,2'-biphenyldisulfonic acid or 4,4'-diaminostilbene-2,2'-disulfonic acid.

4. The method of claim 1 wherein the cyclic dicatoxylate is benzene-1,4-dicarbonyl chloride.

5. The method of claim 1 wherein the structurally rigid anionic polymer is poly(4,4'-diamino-2,2'-biphenyldisulfonic acid/benzene-1,4-dicarbonyl chloride); cross-linked poly(4,4'-diamino-2,2'-biphenyldisulfonic acid/benzene-1,4-dicarbonyl chloride); poly(4,4'-diaminostilbene-2,2'-disulfonic acid/benzene-1,4-dicarbonyl chloride); cross-linked poly(4,4'-diaminostilbene-2,2'-disulfonic acid/benzene-1,4-dicarbonyl chloride); poly(4,4'-diaminostilbene-2,2'-disulfonic acid/1,2,4,5-benzenetetracarboxylic dianhydride/benzene-1,4-dicarbony chloride; or a copolymer of poly(4,4'-diamino-2,2'-biphenyldisulfonic acid/benzene-1,4-dicarbonyl chloride) and poly(4,4'-diaminostilbene-2,2'-disulfonic acid benzene-1,4-dicarbonyl choride).

6. The method of claim 1 further comprising adding a cationic coagulant to the papermaking furnish.

7. The method of claim 1 further comprising adding a flocculant to the papermaking furnish.

8. The method of claim 1 further comprising adding a microparticle to the papermaking furnish.

9. A paper product prepared by i) adding to a papermaking furnish an effective amount of a structurally rigid anionic condensation polymer of one or more aryldiamines and one or more cyclic dicarboxylates where at least one of the aryldiamines and cyclic dicarboxylates contains an anionic substitutent; and ii) draining the furnish to form a sheet.

* * * * *